US008480552B2

(12) United States Patent
Chawla et al.

(10) Patent No.: US 8,480,552 B2
(45) Date of Patent: Jul. 9, 2013

(54) APPARATUS AND A METHOD FOR FOLDING AND UNFOLDING A FOLDABLE TRANSPORT CONTAINER

(75) Inventors: Anoop Chawla, New Delhi (IN); Sudipto Mukherjee, New Delhi (IN)

(73) Assignee: Simpri Investments Limited, Hong Kong (HK)

( * ) Notice: Subject to any disclaimer, the term of this patent is extended or adjusted under 35 U.S.C. 154(b) by 575 days.

(21) Appl. No.: 12/595,232

(22) PCT Filed: Mar. 17, 2008

(86) PCT No.: PCT/IN2008/000157

§ 371 (c)(1), (2), (4) Date: Jun. 23, 2010

(87) PCT Pub. No.: WO2008/122984

PCT Pub. Date: Oct. 16, 2008

(65) Prior Publication Data

US 2010/0292063 A1 Nov. 18, 2010

(30) Foreign Application Priority Data

Apr. 9, 2007 (IN) ..... 785/DEL/2007

(51) Int. Cl.
*B31B 1/26* (2006.01)

(52) U.S. Cl.
USPC ..... 493/409; 222/92; 222/107; 229/117.01; 229/117.05

(58) Field of Classification Search
USPC ..... 493/409; 222/92, 95, 107; 229/117.01, 229/117.05–117.08
See application file for complete search history.

(56) References Cited

U.S. PATENT DOCUMENTS

| | | | | |
|---|---|---|---|---|
| 5,190,179 | A * | 3/1993 | Richter et al. | 220/6 |
| 5,509,559 | A * | 4/1996 | Okano et al. | 220/1.5 |
| 7,240,799 | B2 * | 7/2007 | Zhang | 206/600 |
| 7,823,739 | B2 * | 11/2010 | Sadkin et al. | 220/6 |
| 7,882,973 | B2 * | 2/2011 | Krohn | 220/1.5 |
| 7,984,819 | B1 * | 7/2011 | Davis | 220/4.28 |
| 8,196,766 | B2 * | 6/2012 | Schrayvogel | 220/7 |
| 2006/0043090 | A1 * | 3/2006 | Ferrini | 220/6 |
| 2007/0108204 | A1 * | 5/2007 | Warhurst et al. | 220/6 |
| 2008/0011745 | A1 * | 1/2008 | Ferrini | 220/4.29 |

FOREIGN PATENT DOCUMENTS

WO WO 2007081556 A2 * 7/2007

* cited by examiner

*Primary Examiner* — Hemant M Desai
(74) *Attorney, Agent, or Firm* — Baker & Mckenzie LLP

(57) ABSTRACT

This invention provides an apparatus and a method for folding and unfolding a foldable transport container automatically. The apparatus comprises plurality of moving parts (P1, P2) and arms (A1, A2, A3, A4) to fold the sides (FS1, FS2) of the container and to fold the top (T) and bottom (B) of the container. Said moving parts and arms are operated by plurality of actuators (H1, H2, H3, H4).

19 Claims, 5 Drawing Sheets

Schematic diagram of a system for folding/unfolding a transport container.

Transport container after the first folding step

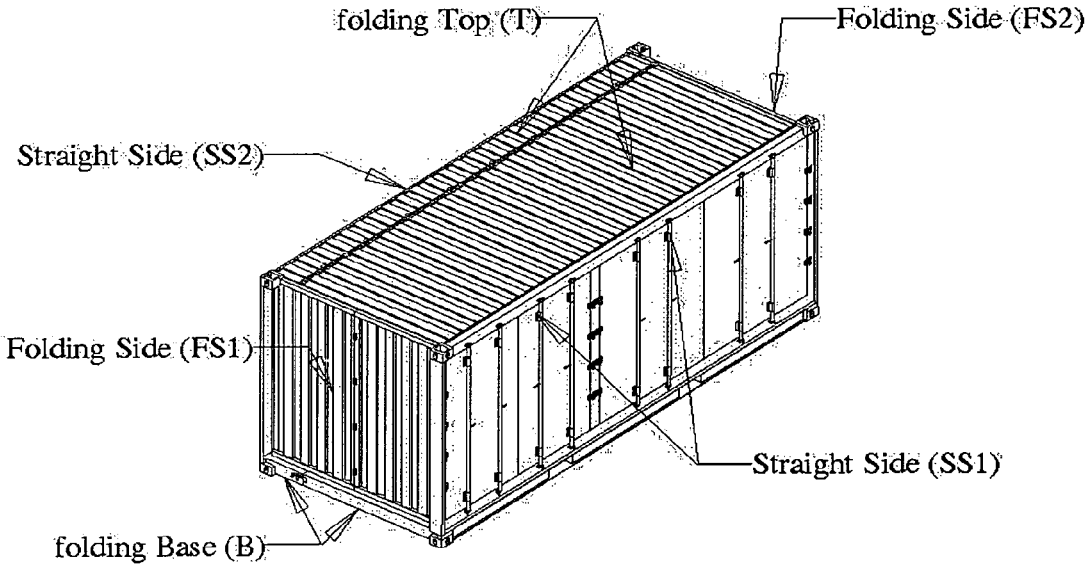
Fig 1: Schematic diagram of a foldable transport container

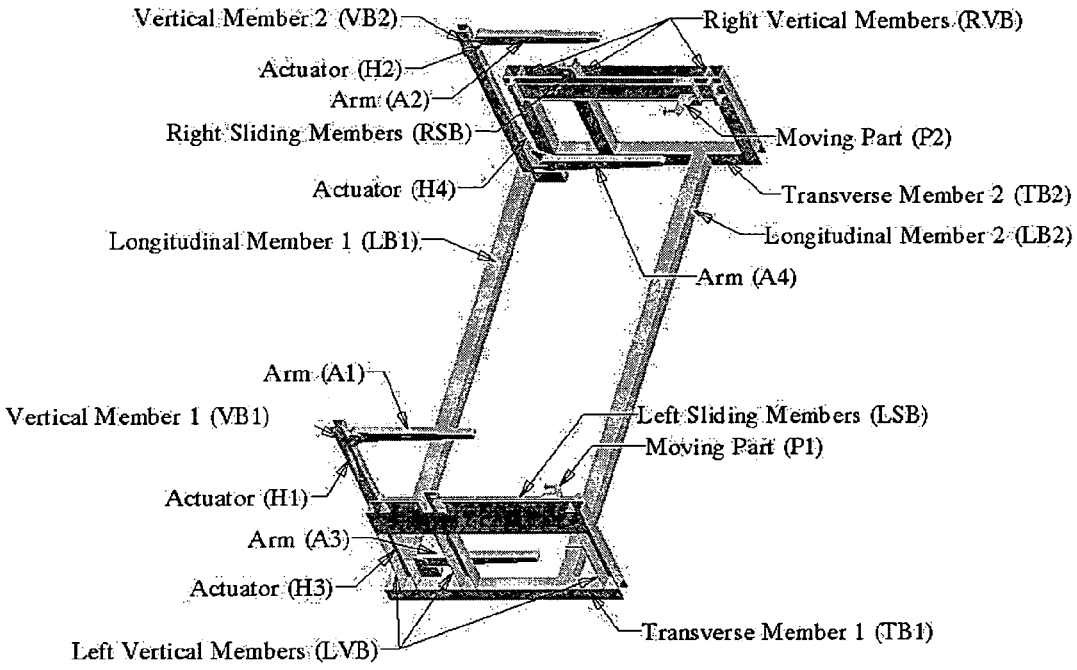
Figure 2: Schematic diagram of a system for folding/unfolding a transport container.

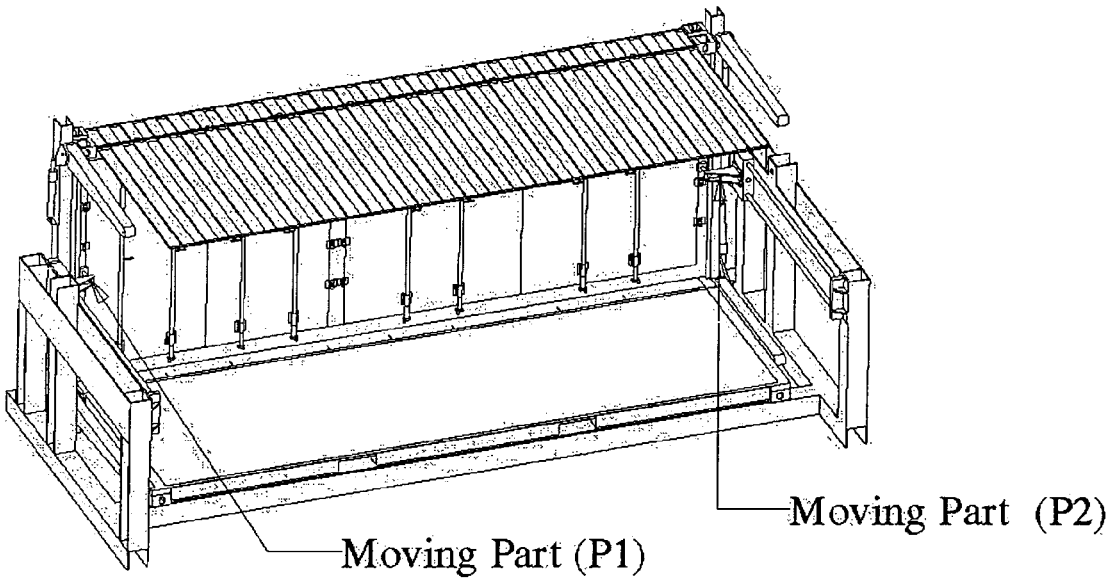
Figure 3: Transport container after the first folding step

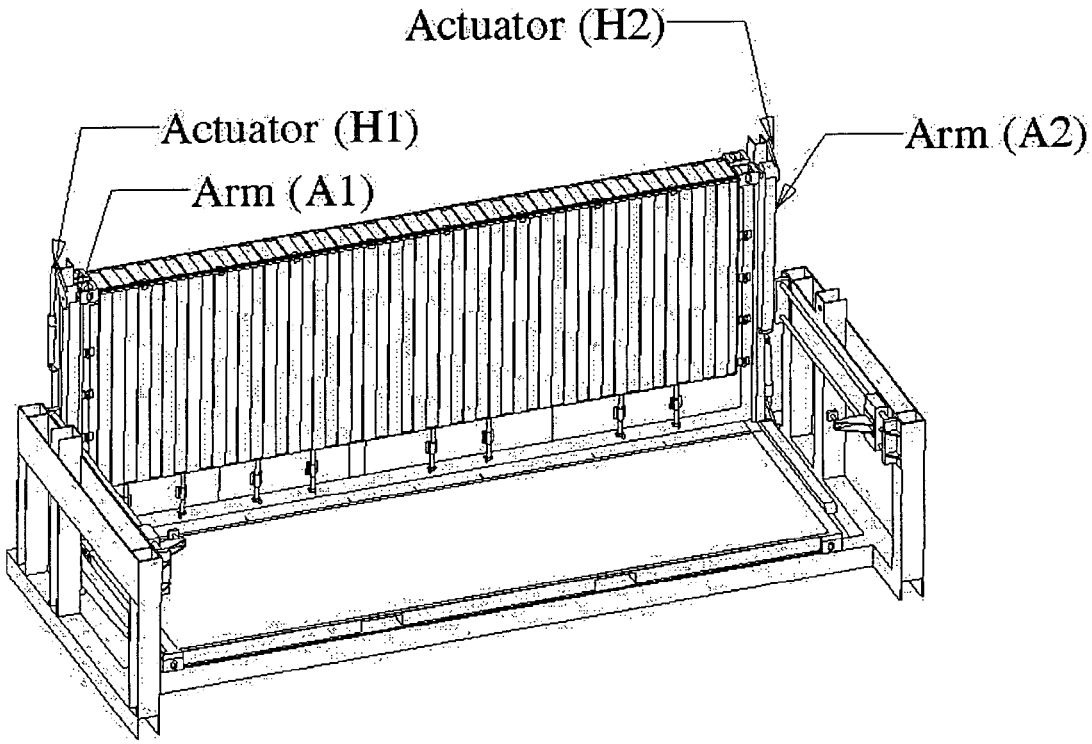
Figure 4: Transport container after the second folding step

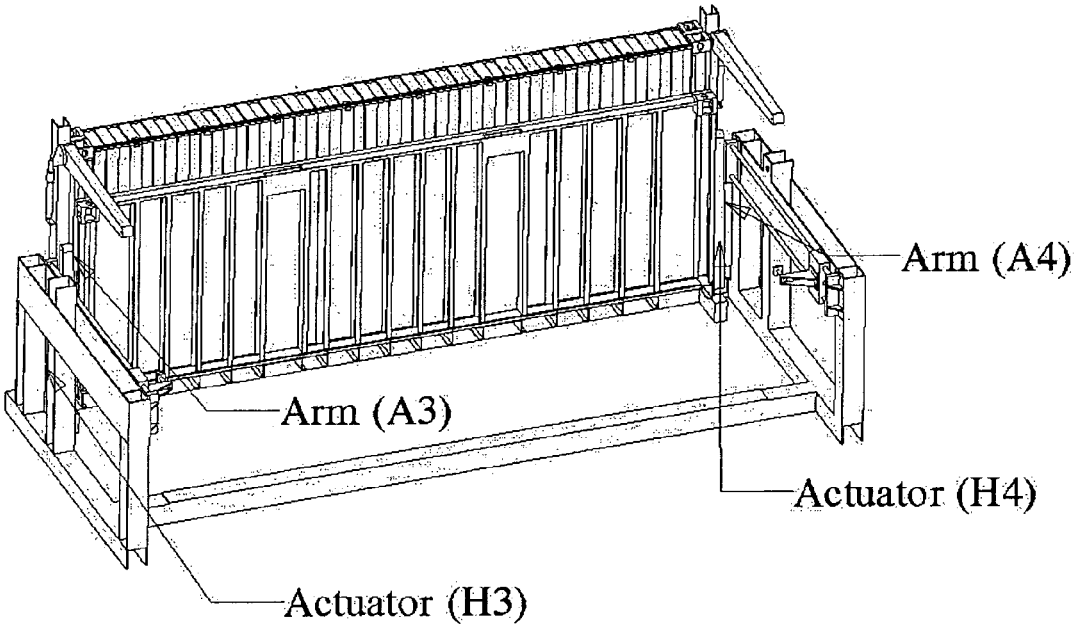
Figure 5: Transport container after the final folding step

APPARATUS AND A METHOD FOR FOLDING AND UNFOLDING A FOLDABLE TRANSPORT CONTAINER

This application is a 371 of PCT/IN2008/000157, filed Mar. 17, 2008, and claims priority to Indian Patent Application No. 785/DEL/2007, filed Apr. 9, 2007, which is incorporated herein by reference in its entirety.

FIELD OF THE INVENTION

This invention relates to an apparatus and a method for folding and unfolding a foldable transport container. More particularly this invention relates to a system and a method for folding and unfolding a foldable transport container automatically.

BACKGROUND

Foldable containers are an attractive option from the point of view of saving transport costs as well as handling and storage costs. So far, however, such containers have not been introduced successfully.

In order to eliminate the disadvantages resulting from the use of rigid-structure, prismatic containers, containers with collapsible structure components have been designed and built. In such containers, after discharge of the cargo, the walls can be folded onto the base so that, the empty container will occupy less space in the collapsed state for transport.

To fold and unfold the collapsible container a sequence of motions are applied which is difficult if done manually. So there is need of a system or an apparatus for folding and unfolding the collapsible container automatically to save labor cost and also time of operation.

OBJECT AND SUMMARY OF THE INVENTION

It is an object of the invention to provide for folding and unfolding a transport container automatically.

To meet the above mentioned objective the instant invention provides an apparatus for folding and unfolding a foldable transport container comprising:

plurality of actuators;

at least one moving parts driven by said actuators for folding at least one side of the container;

at least one arm operated by said actuators for folding the top and base of the container;

a structure for mounting said actuators, moving parts and arms.

In another aspect the present invention provides a method for folding and unfolding a transport container comprising plurality of actuators, at least one moving parts, plurality of arms and a structure, said method comprising the steps of:

moving one side of the container towards or away from the another side of said container by said moving parts;

folding at least one side of the container by said moving parts driven by said actuators;

folding the top and base of the container by said arms operated by said actuators.

BRIEF DESCRIPTION OF THE ACCOMPANYING DRAWINGS

The features of this invention are set forth with particularly in the appended claims. The invention, together with its objects and advantages thereof may be best understood by reference to the following description taken in conjunction with the accompanying drawings, in which like reference numerals identify substantially like elements in the several figures and in which:

FIG. 1 shows a schematic diagram of a foldable transport container.

FIG. 2 shows a schematic diagram of a system for folding and unfolding a transport container according to the present invention.

FIG. 3 represents the state after the first folding step.

FIG. 4 shows the state after the second folding step.

FIG. 5 represents the state after final folding step.

DETAILED DESCRIPTION OF THE INVENTION

For the purpose of promoting an understanding of the principles of the invention, reference will now be made to the embodiment illustrated in the drawings and specific language will be used to describe the same. It will nevertheless be, understood that no limitation of the scope of the invention is thereby intended, such alterations and further modifications in the illustrated apparatus, and such further applications of the principles of the invention as illustrated therein being contemplated as would normally occur to one skilled in the art to which the invention relates.

The folding transport container as shown in FIG. 1 comprises a planar foldable base (B), a foldable top (T), opposing sides (SS1, SS2) and foldable panels (FS1, FS2).

FIG. 2 shows a schematic diagram of a system for folding/unfolding a transport container. The system of the present invention comprises plurality of moving parts. The first moving part (P1) and second moving part (P2) which are driven by actuators (not shown in figure) used to fold the side (SS1) of the container. The system comprises a first pair of arms (A1, A2) which are operated by first and second actuators (H1, H2) to fold the top (T) of the container. The second pair of the arms (A3, A4) of the system, which are operated by the second and third actuators (H3, H4) used to fold the base (B) of the container. The system further comprises a structure S on which said actuators and moving parts are mounted.

FIG. 2 shows the schematic of one embodiment of the invention. Structure S is made up of one or more longitudinal members (LB1, LB2), one or more transverse members (TB1, TB2) and one or more vertical members (VB1, VB2, LVB, RVB). The longitudinal members and the vertical members are rigidly fixed to the transverse members as shown in FIG. 2. Moving. Part P1 is mounted so that it can move freely in the transverse direction on left sliding members (LSB), which are rigidly fixed to the left vertical members (LVB). Similarly moving part P2 is mounted so that it can move freely in the transverse direction on right sliding members (RSB), which are rigidly fixed to right vertical members (RVB). The said moving parts moved by actuators (nor shown in the figure) are used to move the front wall (of the container) towards (or away from) the rear wall.

Actuators H1, H2 are attached by pin joint to top of the vertical members VB1, VB2 respectively. One side of the Arms A1, A2 are rigidly fixed to actuators. H1, H2 respectively and other side fixed through a pin joint to the vertical members VB1, VB2 respectively.

Similarly actuators H3, H4 are attached by pin joint to bottom of the vertical members VB1, VB2 respectively. One side of the Arms A3, A4 are rigidly fixed to actuators H3, H4 respectively and other side fixed through a pin joint to vertical members VB1, VB2 respectively.

FIG. 3 represents the state after the first folding step by the system of the present invention. In this step of folding the container, moving parts (P1 & P2) move horizontally in a linear manner and push the container side SS1 towards the side SS2 resulting in a state as shown in FIG. 3.

In the second step of folding the container, two arms (A1, A2) which are driven by actuators (H1, H2) fold the top (T), and simultaneously the moving parts (P1, P2) return to their original position by resulting in a position as shown in FIG. 4. Here actuators H1 and H2 attached to arms A1 and A2 move upwards, folding the top (T).

In the final step of folding the container, two arms (A3, A4) which are driven by actuators (H3, H4) fold the base (B) and simultaneously the arms (A1, A2) return to its original position by downward movement of actuators H1 and H2 resulting in a position as shown in FIG. 5. In this step actuators H3 and H4 attached to arms A3 and A4 move downwards, folding the bottom (B).

All documents cited in the description are incorporated herein by reference. The present invention is not to be limited in scope by the specific embodiments and examples which are intended as illustrations of a number of aspects of the invention and any embodiments which are functionally equivalent are within the scope of this invention. Those skilled in the art will know, or be able to ascertain using no more than routine experimentation, many equivalents to the specific embodiments of the invention described herein.

We claim:

1. An apparatus for folding and unfolding a foldable transport container, the apparatus comprising:

a plurality of actuators;

at least one moving part driven by said actuators operable to fold at least one side wall of the container;

at least one arm operated by said actuators operable to fold a foldable top and a foldable base of the container; and a structure for mounting said actuators, moving parts, and arms.

2. The apparatus of claim 1, further comprising at least one longitudinal member, at least one transverse member, at least one vertical member, and at least one sliding member.

3. The apparatus of claim 1, wherein said actuators guided by the at least one sliding member are operable to slidably move a first side wall of the container towards a second side wall of the container along a first longitudinal axis.

4. The apparatus of claim 3, wherein the first side wall is a non-foldable side wall.

5. The apparatus of claim 3, wherein the second side wall is a non-foldable side wall.

6. The apparatus of claim 1, wherein the foldable top is a planar foldable top.

7. The apparatus of claim 1, wherein the foldable top comprises two or more foldable top sections.

8. The apparatus of claim 7, wherein the at least one arm is operable to fold the two or more foldable top sections in relation to each other.

9. The apparatus of claim 1, wherein the foldable base is a planar foldable base.

10. The apparatus of claim 1, wherein the foldable base comprises two or more foldable base sections.

11. The apparatus of claim 10, wherein the at least one arm is operable to fold the two or more foldable base sections in relation to each other.

12. The apparatus of claim 1, wherein said actuators guided by the at least one sliding member are operable to fold first and second end walls of the container inwardly along a second longitudinal axis.

13. A method for folding and unfolding a transport container with an apparatus, said method comprising the steps of:

providing the apparatus comprising a plurality of actuators, at least one moving part, at least one arm, and a structure;

slidably moving a first side wall of the container towards a second side wall of said container along a first longitudinal axis by said at least one moving part driven by said actuators;

folding a foldable top of the container by said at least one arm operated by said actuators; and folding a foldable base of the container by said at least one arm operated by said actuators.

14. The method of claim 13, wherein the apparatus further comprises at least one longitudinal member, at least one transverse member, at least one vertical member, and at least one sliding member.

15. The method of claim 13, further comprising folding first and second end walls of the container inwardly along a second longitudinal axis by said at least one moving part driven by said actuators.

16. The method of claim 13, wherein the foldable top comprises two or more foldable top sections.

17. The method of claim 16, wherein the at least one arm is operable to fold the two or more foldable top sections in relation to each other.

18. The method of claim 13, wherein the foldable base comprises two or more foldable base sections.

19. The method of claim 18, wherein the at least one arm is operable to fold the two or more foldable base sections in relation to each other.

* * * * *